US008291977B2

(12) United States Patent
Mire

(10) Patent No.: US 8,291,977 B2
(45) Date of Patent: Oct. 23, 2012

(54) OIL WELL PLUG AND ABANDONMENT METHOD

(75) Inventor: Michael Mire, Houma, LA (US)

(73) Assignee: Gulfstream Services, Inc., Houma, LA (US)

( * ) Notice: Subject to any disclaimer, the term of this patent is extended or adjusted under 35 U.S.C. 154(b) by 75 days.

(21) Appl. No.: 12/463,996

(22) Filed: May 11, 2009

(65) Prior Publication Data

US 2009/0277637 A1 Nov. 12, 2009

Related U.S. Application Data

(60) Provisional application No. 61/051,962, filed on May 9, 2008, provisional application No. 61/059,127, filed on Jun. 5, 2008.

(51) Int. Cl.
*E21B 29/00* (2006.01)
*E21B 19/00* (2006.01)

(52) U.S. Cl. ..... 166/298; 166/55.2; 166/77.52; 166/377

(58) Field of Classification Search ..... 166/297, 166/55.2, 377, 298, 77.51, 311, 382, 75.14
See application file for complete search history.

(56) References Cited

U.S. PATENT DOCUMENTS 3,766,985 A * 10/1973 Willhite ..... 166/302
3,828,852 A 8/1974 Delano
4,043,389 A * 8/1977 Cobb ..... 166/55
4,345,651 A 8/1982 Akkerman et al.
4,427,065 A 1/1984 Watson
4,624,312 A 11/1986 McMullin
4,671,353 A 6/1987 Damina
4,674,573 A 6/1987 Bode
4,722,389 A 2/1988 Arnold
4,782,894 A 11/1988 LaFleur
4,854,383 A 8/1989 Arnold et al.
4,886,121 A * 12/1989 Demny et al. ..... 166/382
4,979,489 A 12/1990 Abbasov et al.
4,995,457 A 2/1991 Baldridge
5,060,542 A 10/1991 Hauk
5,095,988 A 3/1992 Bode
5,139,006 A * 8/1992 Trudeau ..... 125/12
5,236,035 A 8/1993 Brisco et al.
5,245,982 A * 9/1993 Trudeau ..... 125/12
5,293,933 A 3/1994 Brisco
5,386,746 A 2/1995 Hauk
5,413,086 A * 5/1995 Trudeau ..... 125/23.01
(Continued)

FOREIGN PATENT DOCUMENTS

JP 2003-214078 7/2003

*Primary Examiner* — Giovanna Wright
(74) *Attorney, Agent, or Firm* — Garvey, Smith, Nehrbass & North, L.L.C.; Charles C. Garvey, Jr.; Vanessa M. D'Souza

(57) ABSTRACT

A method of severing a well string that extends into an oil well from an oil platform with a deck includes supporting upper and lower sections of the well string, the lower section supported at the platform deck with a deck located string support. A shear mechanism cuts the well string at a position that can be above the deck located string support. The upper section is then lifted a selected distance and the deck located string support again supports the string at a position below the cut.

33 Claims, 12 Drawing Sheets

U.S. PATENT DOCUMENTS 5,435,390 A 7/1995 Baugh et al.
5,443,122 A 8/1995 Brisco
5,676,492 A * 10/1997 Van Steijn ..... 405/195.1
5,758,726 A 6/1998 Streich et al.
5,833,002 A 11/1998 Holcombe
5,856,790 A 1/1999 Baugh et al.
5,960,881 A 10/1999 Allamon et al.
6,142,226 A 11/2000 Vick
6,182,752 B1 2/2001 Smith, Jr. et al.
6,390,200 B1 5/2002 Allamon et al.
6,575,238 B1 6/2003 Yokley
6,672,384 B2 1/2004 Pedersen et al.
6,715,541 B2 4/2004 Pedersen et al.
6,827,145 B2 * 12/2004 Fotland et al. ..... 166/298
6,904,970 B2 6/2005 Simson
7,021,381 B1 4/2006 Remedies et al.
7,055,611 B2 6/2006 Pedersen et al.
7,055,632 B2 * 6/2006 Dallas ..... 175/382
7,066,249 B2 6/2006 Simson
7,156,170 B2 * 1/2007 Fotland et al. ..... 166/77.51
7,225,873 B2 6/2007 Schlegelmilch et al.
7,243,646 B2 * 7/2007 Todack ..... 125/23.01
7,527,100 B2 * 5/2009 Abadie ..... 166/298
7,607,481 B2 10/2009 Barbee
7,645,093 B1 * 1/2010 Clark et al. ..... 405/173
2005/0082063 A1 * 4/2005 Fotland et al. ..... 166/298
2008/0105436 A1 * 5/2008 Molina et al. ..... 166/365

* cited by examiner

OIL WELL PLUG AND ABANDONMENT METHOD

CROSS-REFERENCE TO RELATED APPLICATIONS

Priority of U.S. Provisional Patent Application Ser. No. 61/051,962, filed 9 May 2008, and U.S. Provisional Patent Application Ser. No. 61/059,127, filed 5 Jun. 2008, incorporated herein by reference, are hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil well plug and abandonment operations. More particularly, the present invention relates to an improved method wherein strings of tubular members such as production tubing, casing and the like are pulled from the well bore a length at a time, wherein at least some of the tubular members are concentric sections with concrete therebetween and wherein a single shearing cut is made through multiple of the concentric layers and the concrete using a pair of opposed blades that shear the concentric layers and the concrete.

2. General Background of the Invention

Presently, plug and abandonment of an oil well utilizes cold cutting of the sections of tubulars as they are removed from the well. This cold cutting is done with a saw. Coal cutting is very time consuming. It can be complicated if layers of concrete are provided in addition to multiple layers of tubular members such as multiple layers of casing. Concrete or cement must be manually removed by hammer and/or chisel.

Another method of cutting tubulars that are being removed from an oil well is to manually cut with a cutting torch. However, such use of cutting torches can generate injury or death if a pocket of natural gas is trapped in between layers of casing or tubing. Such a pocket of gas can be ignited by the open flame of a cutting torch generating an explosion.

The cutting and removal of sections of tubular production pipe, production casing or the like from an oil well is thus a time consuming and potentially hazardous activity.

BRIEF SUMMARY OF THE INVENTION

The present invention provides an improved method of severing oil well strings of production tubing and/or casing in a well abandonment operation, especially effective when multiple concentric layers of casing and/or concrete (or cement) are part of the tubular string.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 5:
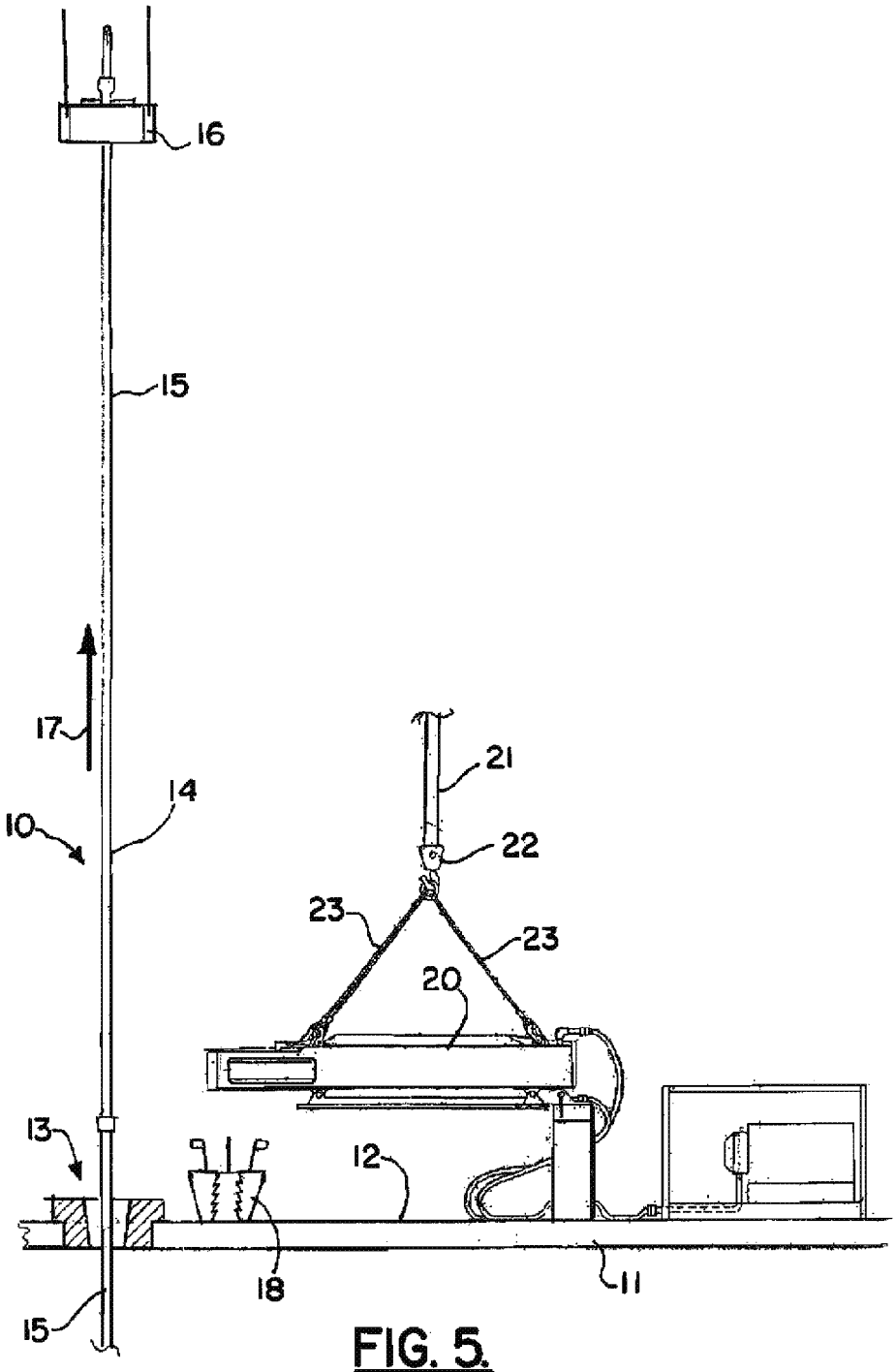
FIG. 5 is an elevation view illustrating the method of the present invention.
Figure 6:
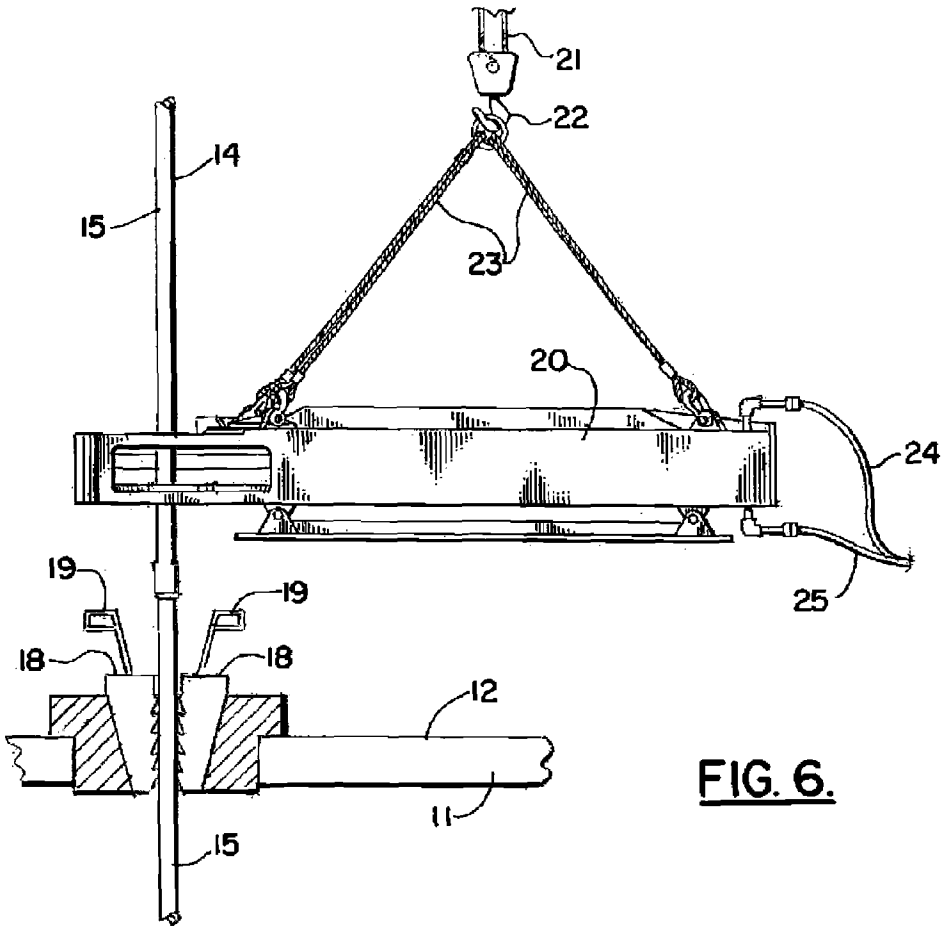
FIG. 6 is an elevation view illustrating the method of the present invention.

The present invention provides an improved plug and abandonment method for an oil well. In FIG. 5, an oil well is shown, designated generally by the numeral 10. Oil well 10 typically involves an oil platform 11 having a deck area 12 with an opening 13 through which tubular sections of material are inserted into the well. Such tubular members are connected end-to-end to form a string 14. The string 14 can be a string of production tubing 15 as shown in FIG. 5. In FIG. 5, a lifting device 16 pulls the pipe to be removed upwardly in the direction of arrow 17. Slips 18 can be used to hold the production pipe 15 or string 14 in a selected position as shown in FIG. 6. The slips 18 can be provided with handles 19 as is known.

Figure 7:
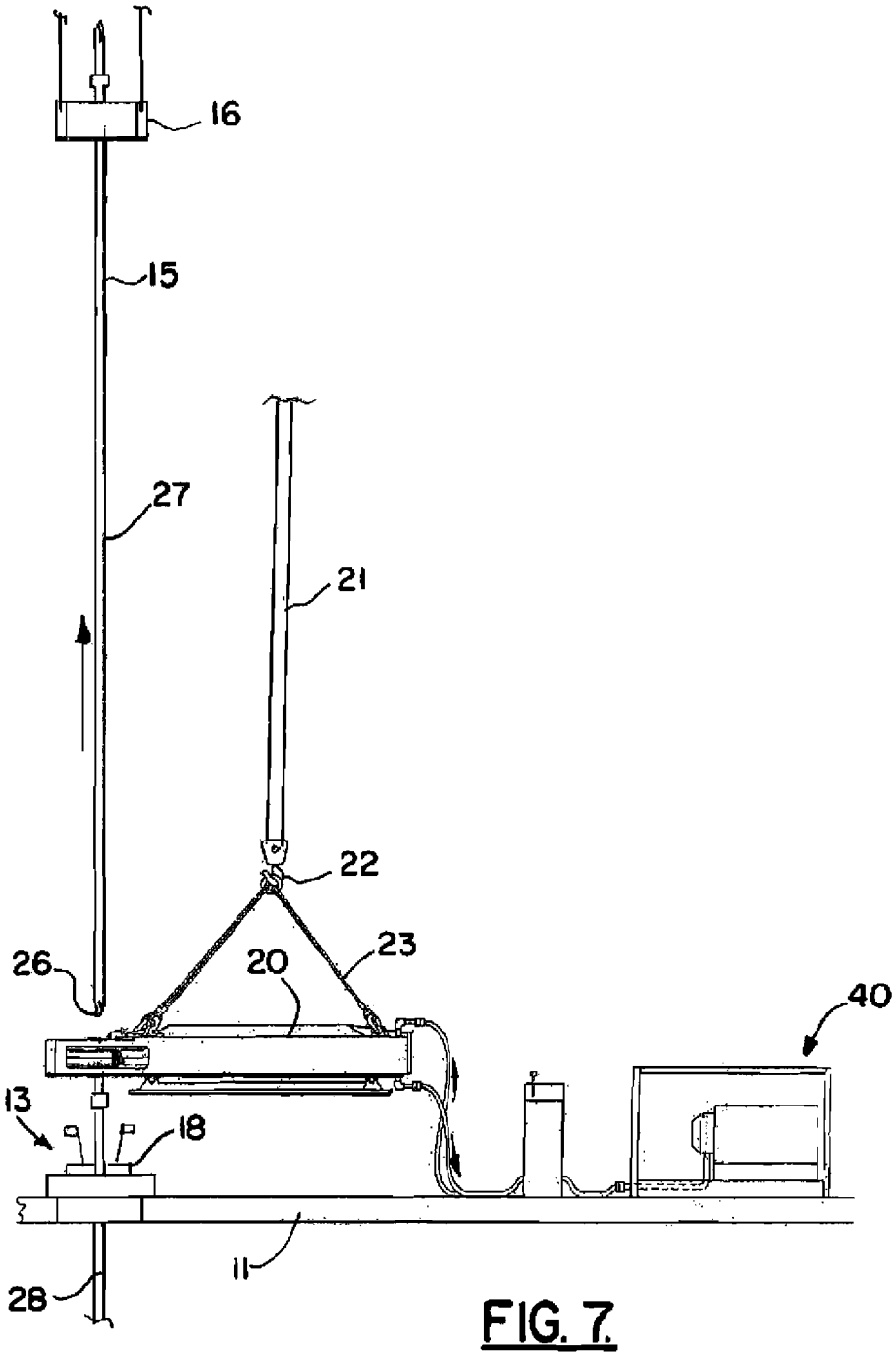
FIG. 7 is an elevation view illustrating the method of the present invention.

A shear mechanism 20 is hydraulically powered. The shear 20 can be supported with a lifting apparatus such as a crane having a lifting line 21, hook 22 and rigging 23. Hydraulic lines 24, 25 supply hydraulic fluid from hydraulic power unit 40 to the hydraulic cylinder or ram 47 of shear mechanism 20. In FIG. 7, a cut at 26 severs an upper part 27 of well string 14 or production tubing 15 from a lower part 28. The upper part 27 can be removed using the lifting device 16. The lower part 28 remains secured to the platform 11 using slips 18.

Figure 8:
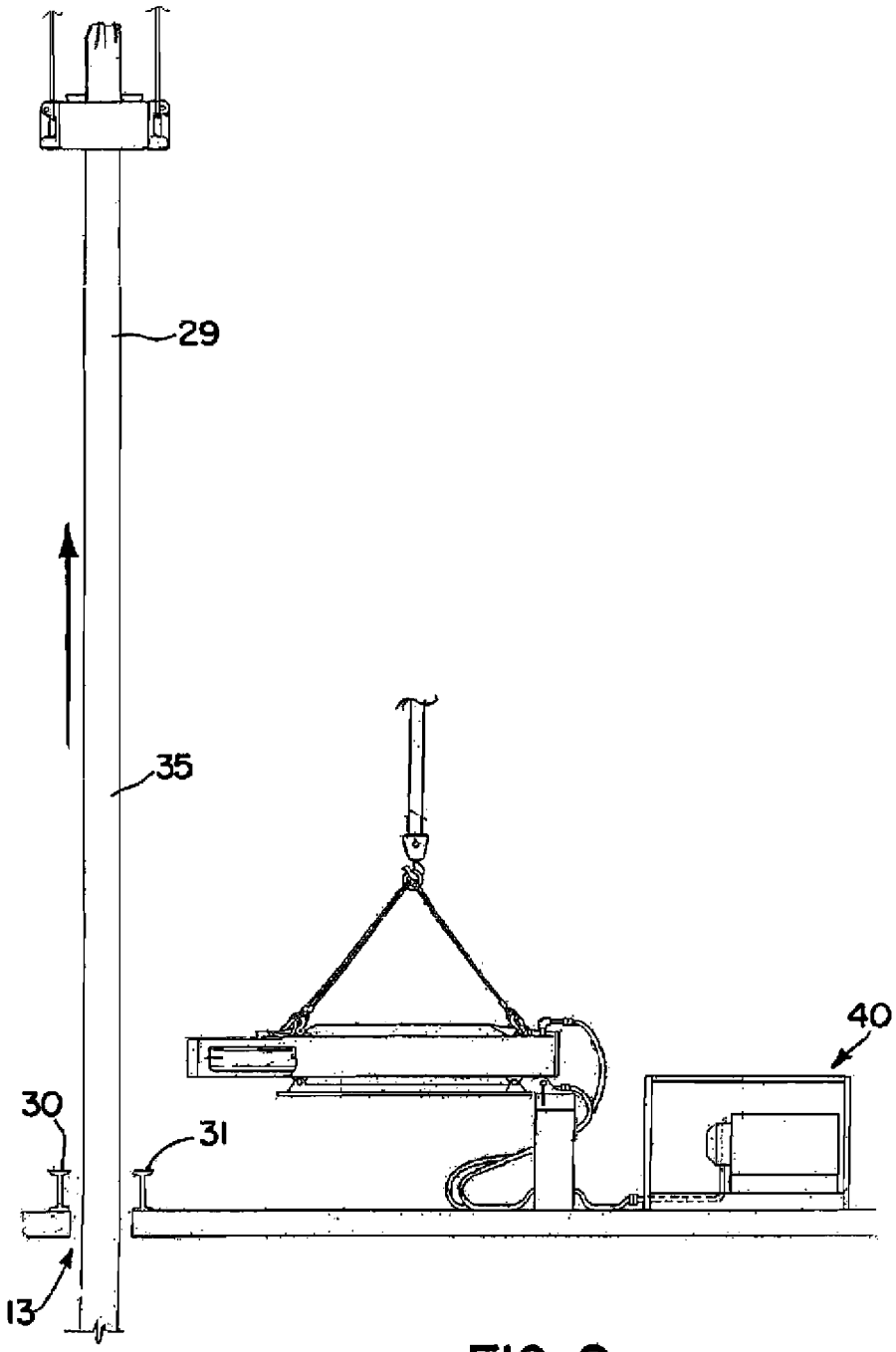
FIG. 8 is an elevation view illustrating the method of the present invention.
Figure 9:
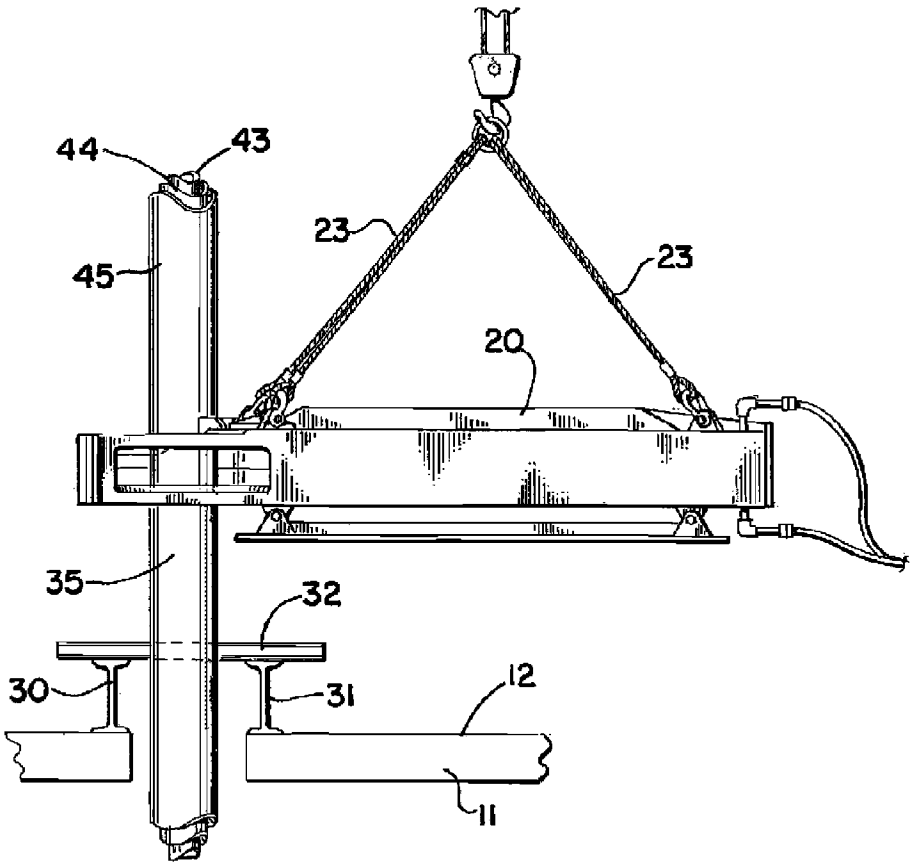
FIG. 9 is an elevation view illustrating the method of the present invention.
Figures 10, 11, 12:
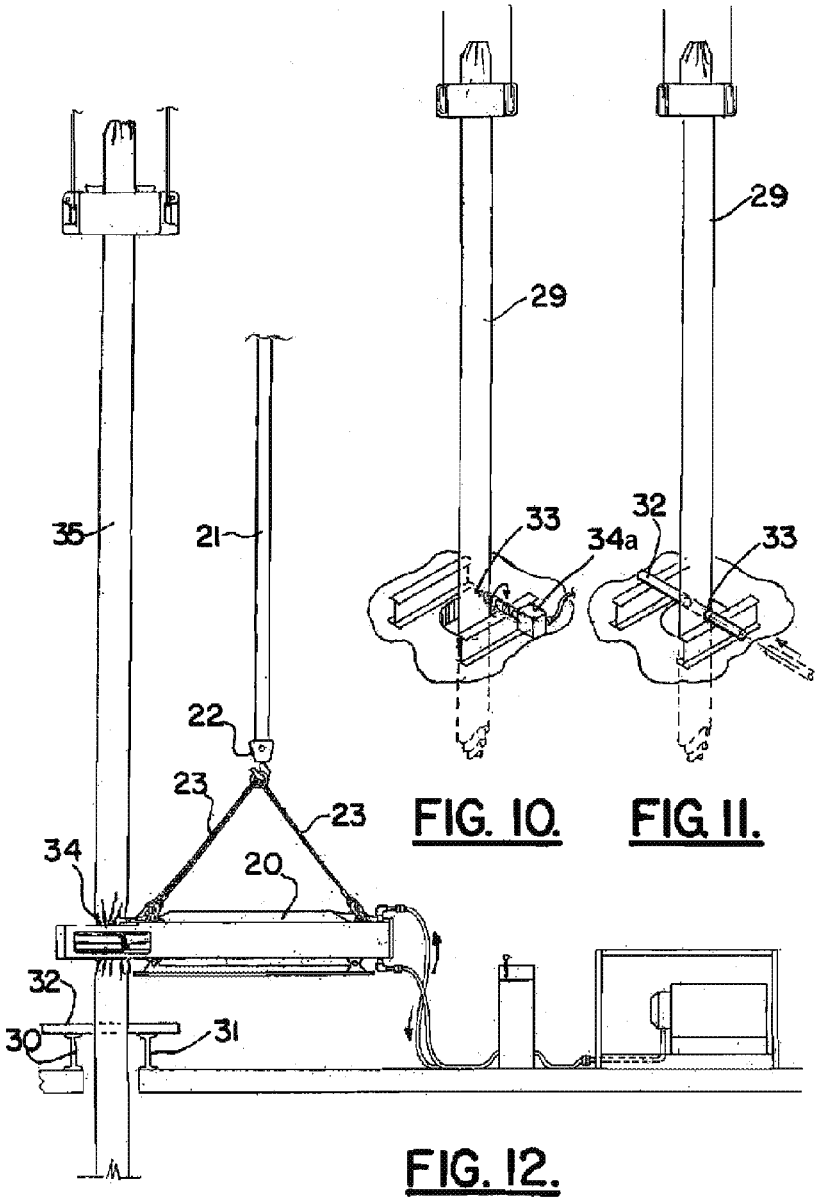
FIG. 10 is an elevation view illustrating the method of the present invention.
FIG. 11 is an elevation view illustrating the method of the present invention.
FIG. 12 is an elevation view illustrating the method of the present invention.
Figure 13:
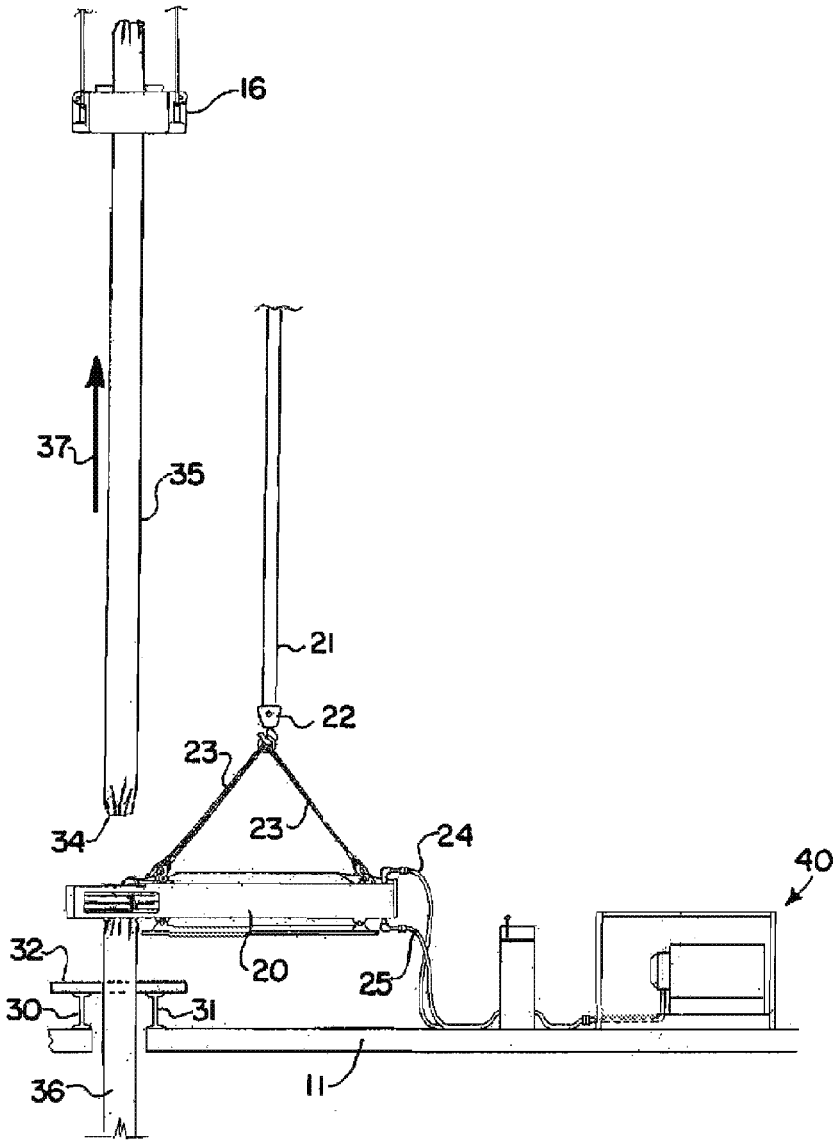
FIG. 13 is an elevation view illustrating the method of the present invention.

FIG. 8 illustrates a severing of a section of casing 29. Beams are placed at 30, 31 on opposing sides of opening 13 as shown in FIG. 8. In FIGS. 10 and 11, a drill 34*a* can be provided for forming an opening through the casing string 29. FIG. 10 shows a drill 34*a* forming the drilled opening in casing string 29. Pin 32 is then placed through the drilled opening 33 as shown in FIGS. 11 and 12. Once the casing string 29 is supported with the pin 32 and beams 30, 31, the shear mechanism 20 performs a cut at 34 severing the casing string 29 into an upper section 35 and a lower section 36. The upper section 35 can be removed upwardly using lifting device 16 as indicated by arrow 37 in FIG. 13. The lower section 36 of casing string 29 remains secured using pin 32 and beams 30, 31.

Figure 14:
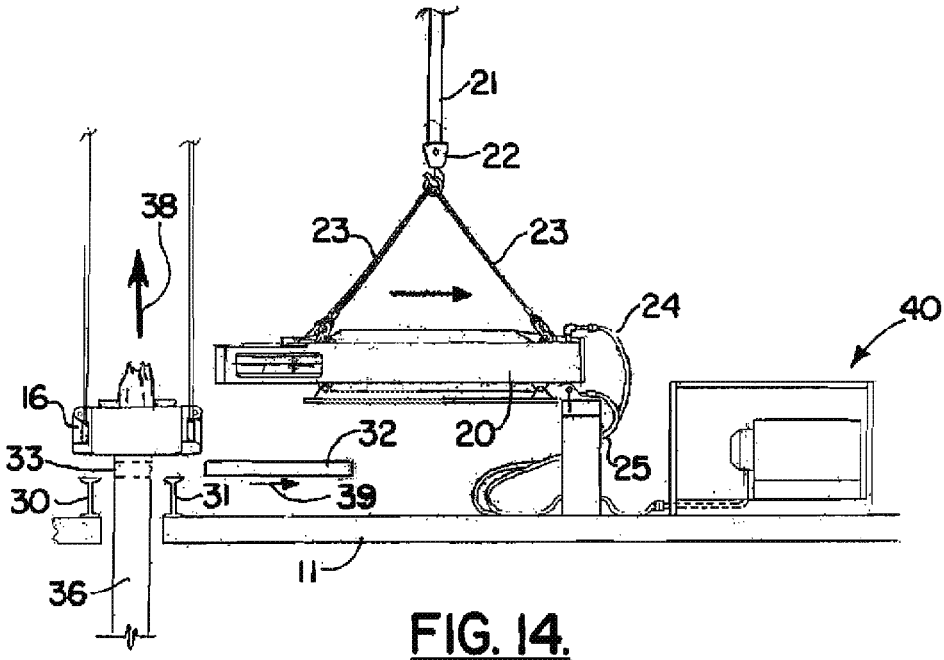
FIG. 14 is an elevation view illustrating the method of the present invention.

In FIG. 14, the lifting device 16 grabs the lower section 36 of casing string 29 and lifts it upwardly in the direction of arrow. Once the pin 32 has been lifted above beams 30, 31, the pin 32 can be removed from opening 33 as indicated by arrow 39 in FIG. 14.

Figure 15:
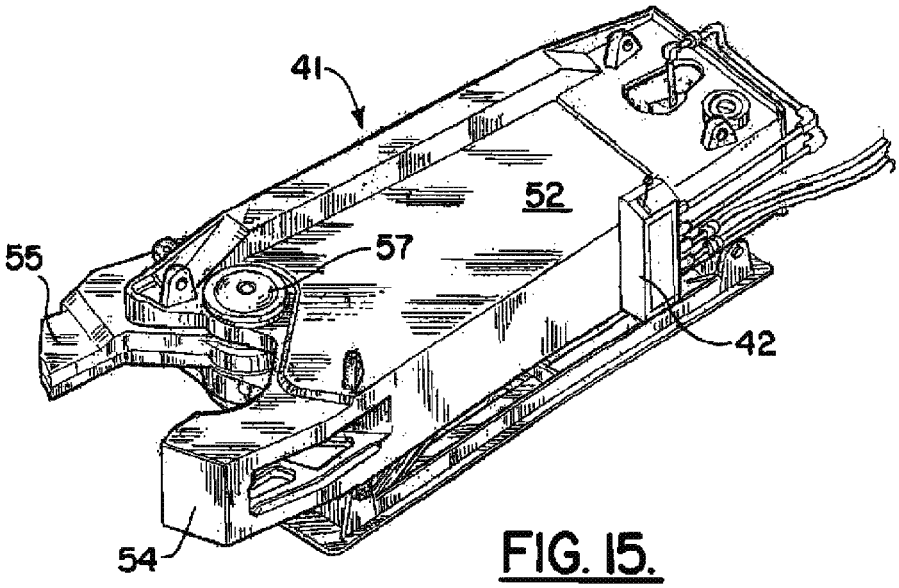
FIG. 15 is a fragmentary perspective view of the preferred embodiment of the apparatus of the present invention and illustrating a shear that is used with the method of the present invention.

In FIG. 15, a control panel 42 is attached directly to the shear mechanism 41. The control panel 42 can be used to control various functions of the shear mechanism such as for example opening and closing of the jaws 54, 55.

Figure 3:
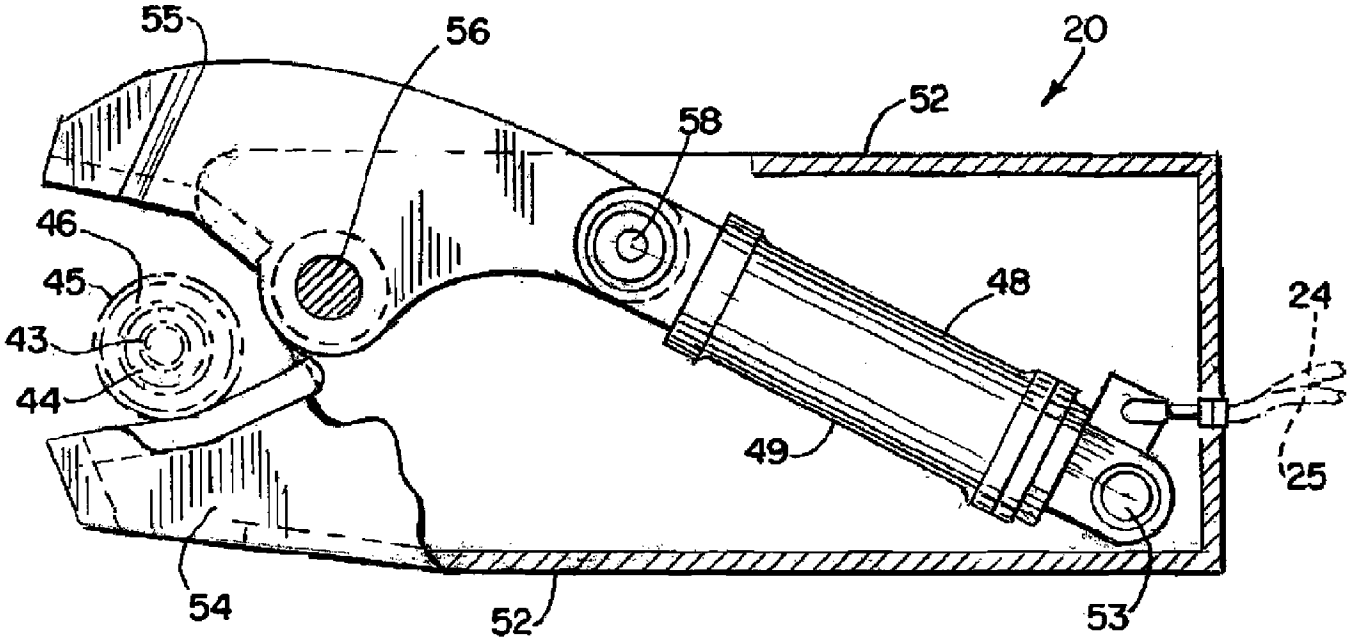
FIG. 3 is a top sectional view of the preferred embodiment of the apparatus of the present invention and showing a shear that is used with the method of the present invention.
Figure 4:
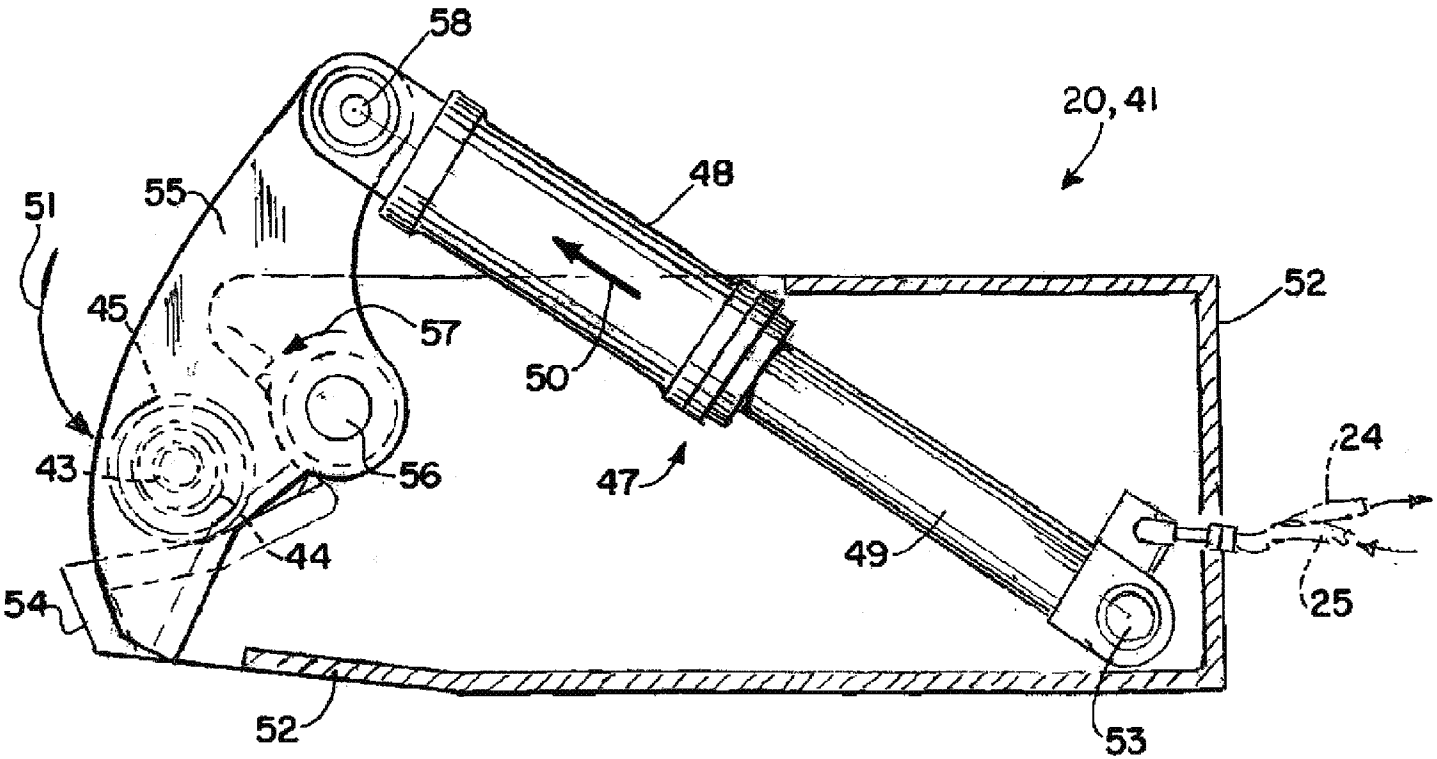
FIG. 4 is a top sectional view of the preferred embodiment of the apparatus of the present invention and showing a shear that is used with the method of the present invention, in a closed position.

FIGS. 3 and 4 illustrate the cut that is made through casing string 29. In many cases, the casing string 29 can include concentric tubular members 43, 44, 45. Additionally, concrete or cement has been placed in between the layers 43, 44 or 44, 45 as indicated by the numeral 46 in FIG. 3. In FIG. 4, the shear mechanism 20 or 41 can be provided with a hydraulic ram 47 having a cylinder 48 and a pushrod 49. The ram 47 is extendable as indicated by arrow 50 in FIG. 4.

As the ram 47 is extended, moving jaw 55 rotates about pivot 56 relative to fixed jaw 54. A pinned connection at 58 can be used to join ram 47 to moving jaw 55. Arrow 57 in FIG. 4 illustrates a rotation of moving jaw 55 about pivot 56. Arrow 51 in FIG. 4 illustrates the cutting action of moving jaw 55 as it cuts through multiple casing layers or tubular members 43, 44, 45.

Figure 1:
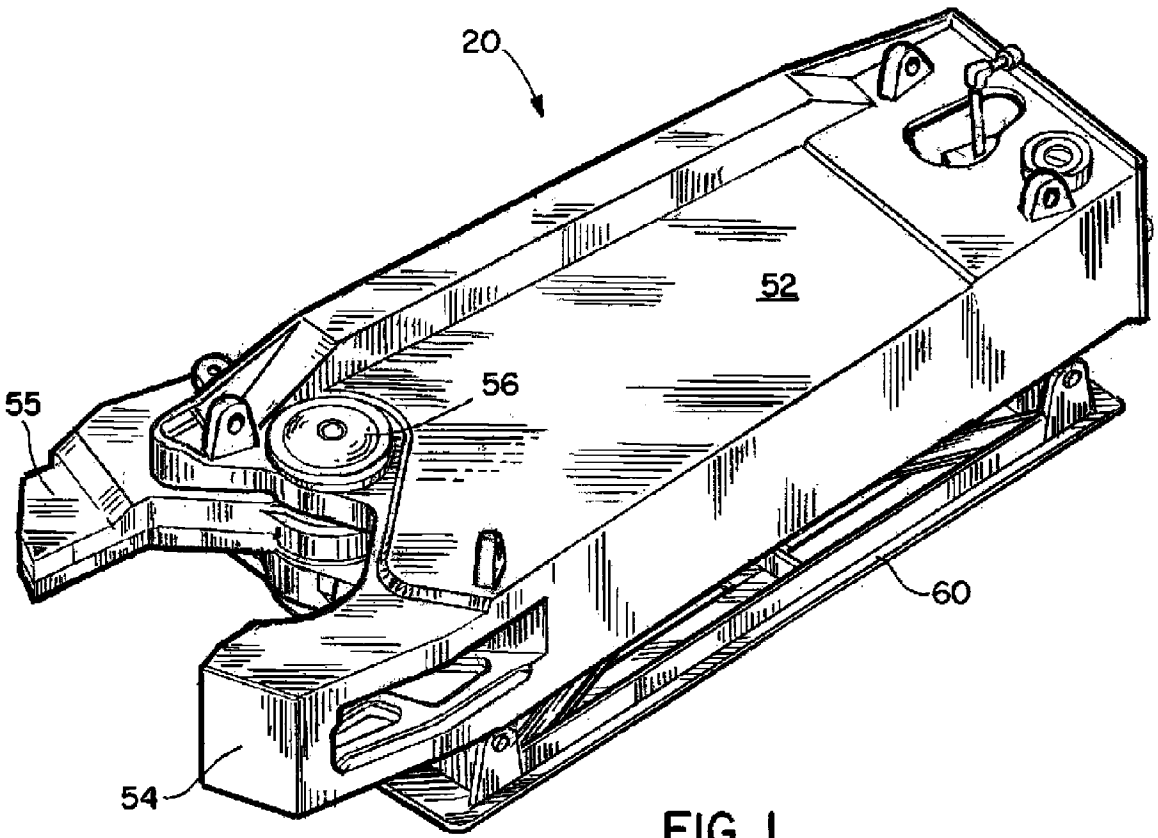
FIG. 1 is a partial perspective view of the preferred embodiment of the apparatus of the present invention and showing a shear that is used with the method of the present invention.
Figure 2:
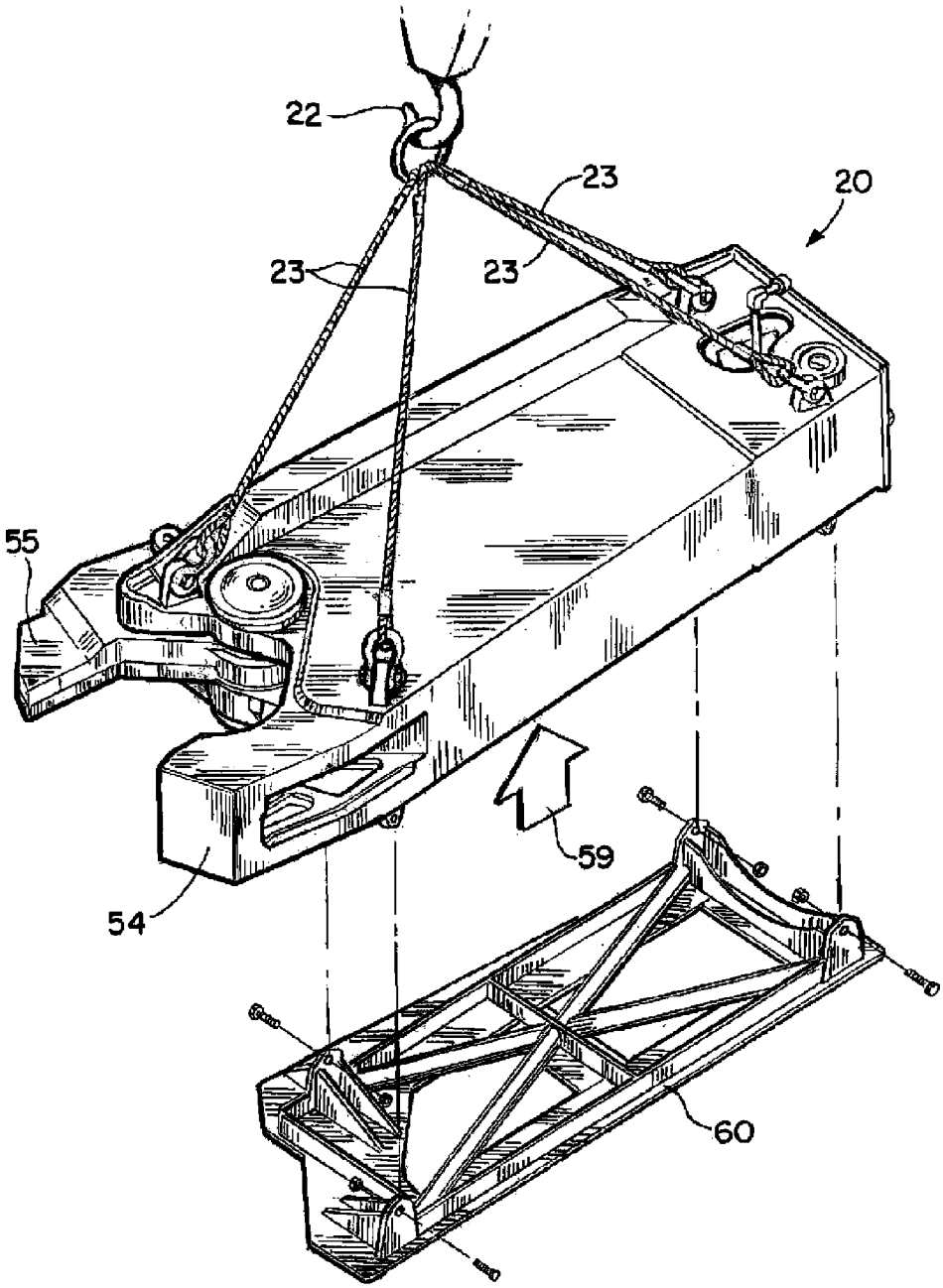
FIG. 2 is a partial perspective view of the preferred embodiment of the apparatus of the present invention and showing a shear that is used with the method of the present invention.

The ram 45 is connected housing 52 using a pinned connection at 53. Moving jaw 55 connects to housing 52 at pivotal connection 56. Either of the shear mechanisms 20, 41 can be provided with a cradle 60. Lifting arm 21 and hook 22 can be used to lift shear mechanism 20 or 41 from cradle 60 as illustrated by arrow 59 in FIG. 2.

The following is a list of parts and materials suitable for use in the present invention.

PARTS LIST

| Part Number | Description |
|---|---|
| 10 | oil well |
| 11 | platform |
| 12 | deck area |
| 13 | opening |
| 14 | well string |
| 15 | production tubing |
| 16 | lifting device |
| 17 | arrow |
| 18 | slips |
| 19 | handle |
| 20 | shear |
| 21 | lifting line |
| 22 | hook |
| 23 | rigging |
| 24 | hydraulic fluid line |

-continued

| Part Number | Description |
|---|---|
| 25 | hydraulic fluid line |
| 26 | cut |
| 27 | upper part |
| 28 | lower part |
| 29 | casing string |
| 30 | beams |
| 31 | beams |
| 32 | pin |
| 33 | drilled opening |
| 34 | cut |
| 35 | upper section |
| 36 | lower section |
| 37 | arrow |
| 38 | arrow |
| 39 | arrow |
| 40 | hydraulic power unit |
| 41 | shear |
| 42 | control panel |
| 43 | tubular member |
| 44 | tubular member |
| 45 | tubular member |
| 46 | concrete |
| 47 | ram |
| 48 | cylinder |
| 49 | pushrod |
| 50 | arrow |
| 51 | arrow |
| 52 | housing |
| 53 | connection |
| 54 | fixed jaw |
| 55 | moving jaw |
| 56 | pivot |
| 57 | arrow |
| 58 | connection |
| 59 | arrow |
| 60 | cradle |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of severing a well string that extends into an oil well from an oil platform with a deck, comprising the steps of:

a) supporting upper and lower sections of the well string above said deck;

b) providing a hydraulic shear mechanism having a frame and a pair of jaws, one jaw that pivotally moves relative to said frame between open and closed positions, wherein there is a open end of the frame in between the jaws that enables quick placement of the well string in between the jaws when the jaws are in the open position;

c) moving the shear mechanism to a position above the platform deck and away from the well string;

d) opening the jaws to the open position and then placing the well string in between the jaws via the open end of the frame;

e) shearing the well string to form a cut by pivoting at least one jaw relative to the frame so that the jaws are in the closed position, in said closed position the jaws abutting to form said cut and wherein a hydraulic cylinder pivots said at least one jaw relative to the frame to achieve said closed position;

f) removing the upper well string section that is above the cut of step "e";

g) lifting the lower section of the well string upwardly a selected distance so that it provides upper and lower sections of the well string above the deck; and h) repeating steps "a" through "f" and wherein the shear mechanism remains above the deck.

2. The method of claim 1 wherein the well string is production tubing.

3. The method of claim 1 wherein the well string is casing.

4. The method of claim 3 wherein the casing includes multiple concentric casings defining multiple layers.

5. The method of claim 4 wherein there is cementitious material between at least two of said layers.

6. The method of claim 4 wherein step "a" comprises drilling an opening through the well string and inserting a pin through the drilled opening.

7. The method of claim 3 wherein step "a" comprises drilling an opening through the well string and inserting a pin through the drilled opening.

8. The method of claim 1 wherein in step "a" slips support the well string at least in part.

9. The method of claim 1 wherein step "a" comprises drilling an opening through the well string and inserting a pin through the drilled opening.

10. The method of claim 9 wherein the pin rests upon a pair of spaced apart beams in step "a".

11. The method of claim 1, wherein the well string is a production casing.

12. A method of severing a well string that extends into an oil well from an oil platform with a deck, comprising the steps of:

a) supporting the well string at a first elevation, the well string including upper and lower sections;

b) providing a hydraulic shear mechanism that has a frame, one fixed jaw on the frame and one moving jaw that pivotally attaches to the frame, said moving jaw being movable between open and closed positions, wherein there is provided an open end in between the jaws into which an elongated section of well string can be placed by moving the well string horizontally;

c) placing the shear mechanism next to the platform deck with the moving jaw in the open position to accept the well string;

d) moving the well string and shear mechanism relative to one another so that the well string moves into the open end of the frame and wherein the well string is positioned in between the jaws;

e) shearing the well string with the shear mechanism to form a cut in the well string;

f) removing the upper, cut well string section above the cut;

g) elevating the well string a selected distance so that upper and lower well string sections are provided above said deck;

h) repeating steps "c" through "g", wherein the shear mechanism remains above the deck.

13. The method of claim 12 wherein the well string is production tubing.

14. The method of claim 12 wherein the well string is casing.

15. The method of claim 14 wherein the casing includes multiple concentric casings defining multiple layers.

16. The method of claim 15 wherein there is cementitious material in between at least two of said layers.

17. The method of claim 15 wherein step "a" comprises drilling an opening through the well string and inserting a pin through the drilled opening.

18. The method of claim 14 wherein step "a" comprises drilling an opening through the well string and inserting a pin through the drilled opening.

19. The method of claim 12 wherein in step "a" slips support the well string at least in part.

20. The method of claim 12 wherein step "a" comprises drilling an opening through the well string and inserting a pin through the drilled opening.

21. The method of claim 20 wherein the pin rests upon a pair of spaced apart beams in step "a".

22. The method of claim 12 wherein the well string is a production casing.

23. A method of severing a well string that extends into an oil well from an oil platform with a deck, comprising the steps of:

a) supporting the well string at a first elevation with a support that is positioned at the deck;

b) providing a hydraulic shear mechanism having a frame and a pair ofjaws, one jaw that pivotally moves relative to said frame between open and closed positions, wherein there is a open end of the frame in between the jaws that enables quick placement of the well string in between the jaws when the jaws are in the open position by moving the well string laterally into said open end and in between the jaws;

c) placing the shear mechanism next to and above the platform deck;

d) shearing the well string above the platform deck with the shear mechanism to form a cut in the well string;

e) removing an upper, cut well string section above the cut of step "d";

f) removing the support of step "a";

g) elevating the well string a selected distance; and h) repeating steps "c" through "g", wherein the shear mechanism is positioned above the deck.

24. The method of claim 23 wherein the well string is production tubing.

25. The method of claim 23 wherein the well string is casing.

26. The method of claim 25 wherein the casing includes multiple concentric casings defining multiple layers.

27. The method of claim 26 wherein there is cementitious material in between at least two of said layers.

28. The method of claim 26 wherein step "a" comprises drilling an opening through each of the concentric casings.

29. The method of claim 25 wherein in step "a" the support includes a pin, and the method includes drilling an opening through the well string and inserting the pin through the drilled opening.

30. The method of claim 23 wherein in step "a" the support includes slips that support the well string at least in part.

31. The method of claim 23 wherein in step "a" the support includes a pin, and the method includes drilling an opening through the well string and inserting the pin through the drilled opening.

32. The method of claim 31 wherein the pin rests upon a pair of spaced apart beams.

33. The method of claim 23 wherein the well string is a production casing.

* * * * *